US010288374B1

(12) United States Patent
Fricke et al.

(10) Patent No.: US 10,288,374 B1
(45) Date of Patent: May 14, 2019

(54) SOUND MODERATED MUZZLELOADER

(71) Applicant: Lehigh Defense, LLC, Quakertown, PA (US)

(72) Inventors: David B. Fricke, Trumbauersville, PA (US); Gregory M. Schmell, Souderton, PA (US)

(73) Assignee: LEHIGH DEFENSE, LLC, Quakertown, PA (US)

( * ) Notice: Subject to any disclaimer, the term of this patent is extended or adjusted under 35 U.S.C. 154(b) by 0 days.

(21) Appl. No.: 16/131,226

(22) Filed: Sep. 14, 2018

(51) Int. Cl.
*F41C 9/08* (2006.01)
*F41A 21/30* (2006.01)

(52) U.S. Cl.
CPC ..... *F41A 21/30* (2013.01); *F41C 9/08* (2013.01)

(58) Field of Classification Search
CPC .. F41C 9/08; F41A 21/12; F41A 21/00; F41A 21/30
See application file for complete search history.

(56) References Cited

U.S. PATENT DOCUMENTS

| | | | | |
|---|---|---|---|---|
| 5,623,779 | A | 4/1997 | Rainey, III | |
| 7,877,919 | B2 | 2/2011 | Richards | |
| 2006/0086029 | A1 | 4/2006 | Kirkpatrick | |
| 2008/0282596 | A1* | 11/2008 | Deleeuw | F41A 3/58 42/51 |
| 2011/0296729 | A1 | 12/2011 | Overstreet | |
| 2014/0298702 | A1 | 10/2014 | Johnston | |
| 2015/0013202 | A1* | 1/2015 | Hendricks | F42B 5/025 42/51 |
| 2016/0313082 | A1* | 10/2016 | Shults | F41A 21/30 |
| 2017/0307347 | A1 | 10/2017 | Peterson et al. | |
| 2019/0003801 | A1* | 1/2019 | Ibarguren | F41C 9/08 |

OTHER PUBLICATIONS

Owner's Manual, Instruction Book for: Model 700™ Ultimate Muzzleloader, Remington®, 2014 Remington Arms Company, LLC.
Silencerco Maxim® 50, Instruction Manual, 2017.

* cited by examiner

*Primary Examiner* — J. Woodrow Eldred
(74) *Attorney, Agent, or Firm* — Fox Rothschild LLP

(57) ABSTRACT

A muzzleloader system is disclosed, in which a muzzleloader has an integrally formed, sound moderated barrel and is configured to operate without a breech plug.

16 Claims, 7 Drawing Sheets

Section C-C

SOUND MODERATED MUZZLELOADER

BACKGROUND

A muzzleloader is an antique firearm in which a powder charge and projectile are loaded into the muzzle end of the barrel. Unlike modern breech loaded firearms where the projectile, propellant charge and primer are loaded as prepackaged cartridges, muzzleloaders are typically loaded by ramming a bullet down the barrel with a ramrod until the bullet is seated against a previously loaded propellant charge. A primer may then be loaded at the breech end, in proximity with the propellant. When the primer is struck by an inline firing pin or external hammer, the propellant charge ignites, creating propellant gases that propel the projectile out of the barrel.

In many muzzleloaders, the closed breech end of the barrel is replaced with a screw-in, removable breech plug, which generally facilitates cleaning. However, over time, rapid temperature changes during firing as well as the corrosive nature of many propellants can cause the threads of the breech plug and barrel to seize, making it difficult to remove the breech plug. The breech plug also positions the primer ignition force away from the powder charge, complicating the combustion process.

Additionally, conventional muzzleloaders generate a loud report when fired, which can damage the user's hearing. To reduce the intensity of the report, a sound suppressor may be attached to the barrel of the muzzleloader, but such an attachment can result in a muzzleloader that is very large and cumbersome, and which may still generate a report that is loud enough to impair hearing.

Also, conventional muzzleloaders are typically loaded by pouring loose black powder down a drop tube in the muzzle end of the barrel. If the muzzleloader has a sound suppressor attached to the barrel, this type of loading can be problematic. For example, if the drop tube is not seated properly or retains any of the poured powder along its inner surfaces, some of that powder may settle into the baffles of the sound suppressor, potentially igniting upon firing and causing damage to at least the suppressor and likely generating a significantly louder report.

Accordingly, there is a strong need for an improved design.

SUMMARY

The present disclosure relates generally to a muzzleloader system, and more particularly, to a muzzleloader having an integral sound moderated barrel and configured to operate without a breech plug.

In one aspect, the disclosed technology relates to a sound moderated muzzleloader, comprising: a barrel portion having a forward end, a rearward end, and a central bore, the central bore having a central axis; a sound moderator permanently attached to the forward end of the barrel portion; and at least one seat pin that protrudes into a portion of the central bore of the barrel portion, the at least one seat pin being secured to an interior of the barrel portion; wherein the sound moderator comprises a plurality of baffles, and wherein the rearward end of the barrel comprises a breech configured to receive an ignition device. In one embodiment, the sound moderator further includes at least one pin configured to permanently attach the sound moderator to the forward end of the barrel. In another embodiment, at least one seat pin is formed from a material comprising tungsten carbide. In another embodiment, the total weight of the muzzleloader is about 4 to about 6 pounds. In another embodiment, the ignition device has a length of about 0.5 to about 3 inches. In another embodiment, the at least one seat pin is arranged tangentially to the central bore. In another embodiment, the interior portion of the barrel comprises two seat pins. In another embodiment, the two seat pins are substantially parallel to each other. In another embodiment, the plurality of baffles comprises a tension baffle and secondary baffles, wherein the tension baffle is configured to compress the secondary baffles. In another embodiment, at least one seat pin protrudes across about 60% to about 90% of the diameter of the central bore. In another embodiment, the barrel portion and the sound moderator have a combined length of more than 16 inches. In another embodiment, the breech is configured such that the ignition device cannot contain a projectile. In another embodiment, the ignition device comprises a propellant powder and a primer. In another embodiment, the propellant powder is black powder or black powder substitute. In another embodiment, the muzzleloader does not include a breech plug. In another embodiment, the at least one pin is secured to the interior of the barrel portion by being press-fit into the interior of the barrel portion.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description.

DETAILED DESCRIPTION

Figure 1:
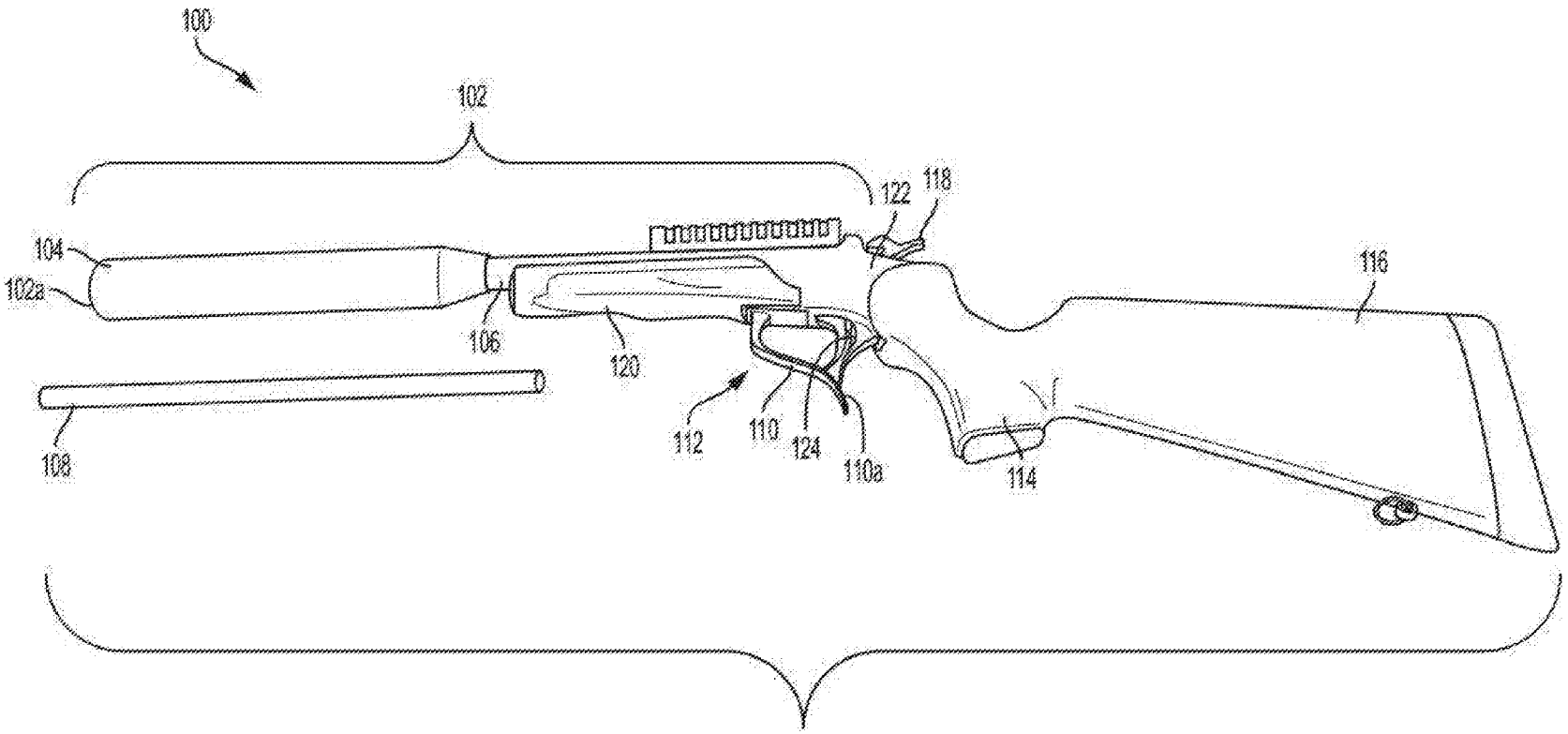
FIG. 1 illustrates a side view of an example moderated muzzleloader.

The following discussion omits or only briefly describes conventional features of muzzleloader systems, such as trigger and firing mechanisms, which are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "comprises" and/or "comprising," when used in this specification, specify the presence of stated features, elements, and/or components, but do not preclude the presence or addition of one or more other features, steps, operations, elements, components, and/or groups thereof.

Embodiments of the present disclosure relate generally to a muzzleloader system, and more particularly, to a muzzleloader having a sound moderated barrel configured to operate without a breech plug. Embodiments of the sound moderated muzzleloader are described below with reference to FIGS. 1-8.

FIG. 1 illustrates a side view of an example muzzleloader 100, according to some embodiments of the present disclosure. The muzzleloader 100 includes at least one of a muzzleloader barrel 102, fire control group 112, grip 114, a stock 116, a hammer 118, a handguard 120, and a receiver 122. In some embodiments, the muzzleloader barrel 102 may include a sound moderator 104 and a barrel portion 106.

In some embodiments, the muzzleloader 100 may be an in-line style muzzleloader. In an embodiment, the muzzleloader 100 may be a break-open style muzzleloader. In another embodiment, the muzzleloader 100 may be a bolt-action style muzzleloader. The below description describes a break-open style muzzleloader, but it should be noted that one or more embodiments described herein are equally applicable to a bolt-action style muzzleloader.

The receiver 122 is configured to house a firing mechanism and associated components as found in, for example, muzzleloaders. The firing mechanism includes the fire control group 112. The fire control group 112 includes a trigger 124 configured to be pulled by a finger (e.g., the index finger) of the user to initiate the firing cycle sequence of the muzzleloader 100. The trigger 124 can have a variety of different shapes. For example, the trigger 124 can have a generally curved profile. In other examples, the trigger 124 can have a generally straight profile. The fire control group 112 may also include a trigger guard 110 formed around the trigger 124, in which each end of the trigger guard 110 is connected to the receiver 122. The trigger guard 110 may protect the trigger 124 from accidental discharge. The fire control group 112 may also include a trigger guard spur 110*a* configured to be pulled by a finger (e.g., the index finger) of the user to open the breech of the muzzleloader 100. The trigger guard spur 110*a* may be a portion of the trigger guard 110 that extends outwards from a lower portion of the trigger guard 110. The trigger guard spur 110*a* can have a variety of different shapes. For example, the trigger guard spur 110*a* can have a generally curved profile. In other examples, the trigger guard spur 110*a* can have a generally straight profile. In yet other examples, the trigger guard spur 110*a* can have a profile extending downwards in a similar direction of the grip 114.

The fire control group 112 is mounted to the receiver 122. The fire control group 112 is configured to discharge the muzzleloader 100 when a predetermined amount of force is applied to the trigger 124. The fire control group 112 is installed in the receiver 122. The fire control group 112 is also configured to open the breech of the muzzleloader 100 when a predetermined amount of force is applied to the trigger guard spur 110*a*.

The stock 116 is configured to be positioned at a rearward portion of the muzzleloader 100. The stock 116 provides an additional surface for the user to support the muzzleloader 100, typically against the user's shoulder. In some embodiments, the stock 116 is integrated with the grip 114. In some embodiments, the stock 116 is a thumbhole stock. In other embodiments, the stock 116 includes a mount for a sling. In yet other embodiments, the stock 116 is a telescoping stock. In other embodiments still, the stock 116 is foldable. In some embodiments, the stock 116 is removably mounted to either the receiver 122 or the grip 114. In at least one embodiment, the stock 116 is threaded to the receiver 122. In other embodiments, the stock 116 is secured to the receiver 122 or the grip 114 by a fastener, such as a takedown screw.

The muzzleloader barrel 102 is positioned at a forward end of the muzzleloader 100 and over a middle portion of the muzzleloader 100. The muzzleloader barrel 102 provides a path to release an explosion, such as one caused by the hammer 118 striking a primer of an ignition device, for example the ignition device 408 illustrated in FIG. 4 and the ignition device 800 illustrated in FIG. 8, and igniting the ignition device, and to propel a projectile, for example the projectile 402 illustrated in FIG. 4, through the muzzleloader barrel 102. The dimensions of the muzzleloader barrel 102 and ignition device are configured such that the ignition device cannot contain a projectile when loaded into the muzzleloader barrel 102.

The muzzleloader barrel 102 may be configured to provide a short platform. The muzzleloader barrel 102 may be also configured in a variety of sizes to correspond to a desired twist rate of a shot projectile. For example, the muzzleloader barrel 102 may be configured to be a fast twist barrel. For instance, the length of the barrel portion 106 may be at least 10 inches, and the length of the sound moderator 104 may be at least 6 inches. In some examples, the muzzleloader 100 can be a high velocity muzzleloader. In yet other examples, the muzzleloader barrel 102 is configured to be a slow twist barrel.

The muzzleloader barrel 102 includes a sound moderator 104 and a barrel portion 106. The sound moderator 104 and the barrel portion 106 are permanently affixed to one another. For example, the sound moderator 104 and barrel portion 106 may be affixed to one another via a blind pin fastened in a hole that extends from an outer diameter of the sound moderator 104 through an inner portion of the sound moderator 104 and into an end portion of the barrel portion 106. The blind pin may extend from an outer diameter of the sound moderator bulkhead through a receiver portion of the sound moderator 104 and into an end portion of barrel portion 106. In another example, the sound moderator 104 may be welded to the barrel portion 106. In some embodiments, the barrel portion 106 of the muzzleloader barrel 102 is attached to the handguard 120 by one or more fasteners. The barrel portion 106 and the sound moderator 104 have a combined length of more than 16 inches.

In some embodiments, the barrel portion 106 is rifled. In other embodiments, the barrel portion 106 has a smoothbore. In some embodiments, the barrel portion 106 includes a rail system for mounting accessories (e.g., a foregrip, a flashlight, a laser, optic equipment, etc.) thereto. The sound moderator 104 may be configured to moderate the sound of a report when a projectile is fired. The sound moderator 104 may also reduce muzzle flash and recoil.

In some embodiments, the overall length of the muzzleloader, from the stock 116 to the muzzle end 102*a* including the barrel portion 106 and sound moderator 104, is about 27 inches to about 35 inches, such as about 31 inches. In one embodiment, the weight of the muzzleloader 100 (loaded or unloaded) is about 4 pounds to about 6 pounds, such as about 4.5 pounds.

The grip 114 provides a point of support for the user of the muzzleloader 100 and can be held by the user's hand, including when operating the fire control group 112. The grip 114 assists the user in stabilizing the muzzleloader 100 during firing and manipulation of the muzzleloader 100. In some embodiments, the grip 114 is mounted to the receiver 122.

To prepare the muzzleloader 100 for firing, a user inserts the drop tube 108 into the muzzle end 102*a* such that an end of the drop tube 108 reaches a portion of the receiver 306 or a portion of the barrel bore 310. Barrel bore 310 is the central bore of the barrel portion 110, in which the central bore has a central axis. A user may insert a projectile, such as projectile 402, into the drop tube 108. In one example, the projectile 402 may travel down the drop tube 108 and land in the barrel bore, such as barrel bore 310. A ramrod (not shown) may then be used to push the projectile 402 through the barrel bore 310 until the projectile is seated on the outer surface of at least one pin. In the non-limiting embodiment depicted in FIG. 5 and discussed herein, two seat pins 416 are shown. In other suitable embodiments, the muzzleloader may have 1, 2, 3, 4, 5, or more pins. Also, as used herein, the term "pin" or "pins" (e.g., seat pins 416) on which the projectile is seated refers to a round pin, screw, square pin, flat pin, solid cylindrical pin, tapered pin, groove pin, spring pin, or any other shaped component or structure that would serve the same purpose described herein. The ramrod and drop tube 108 are removed from the muzzleloader 100 prior to firing. While the muzzleloader 100 is in a break open position, an ignition device, such as ignition device 408, may be inserted into a breech opening, such as breech 414, in a breech end of the barrel portion 106. The muzzleloader 100 is returned to the closed position, and is ready to be fired.

Figure 4:
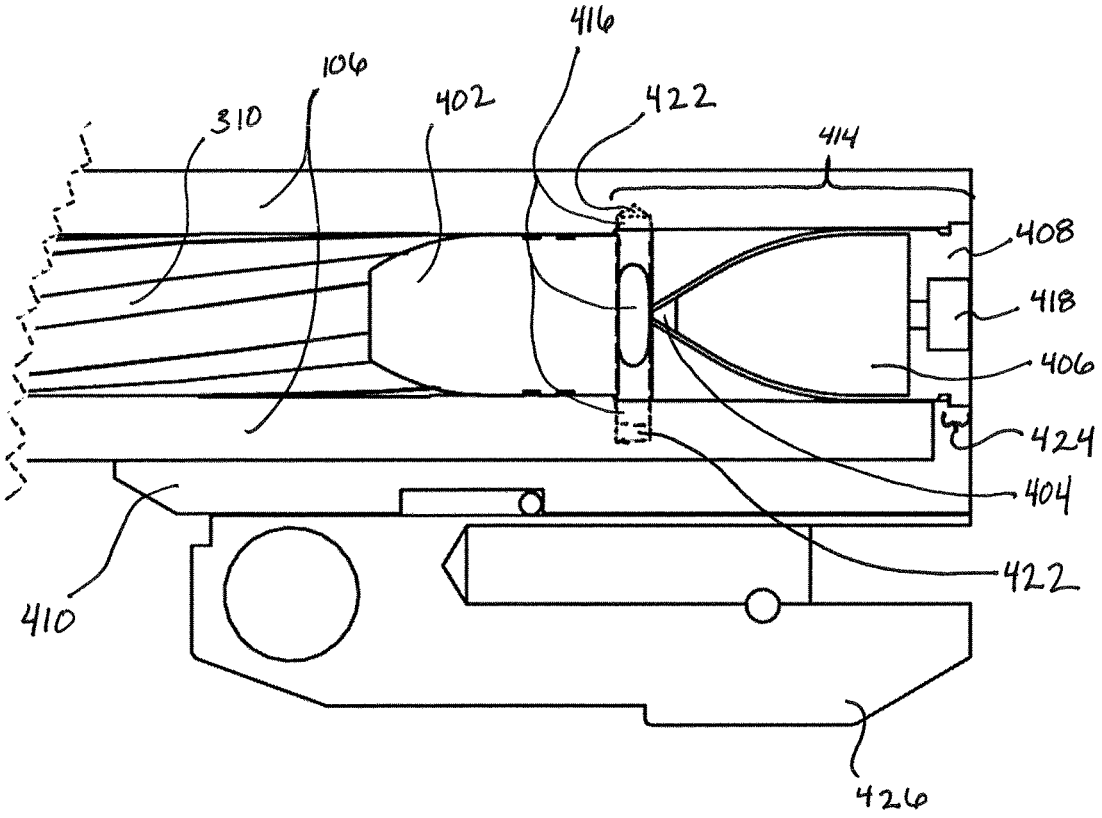
FIG. 4 illustrates an enlarged view of detail B highlighted in the cross-sectional view of the muzzleloader barrel depicted in FIG. 3.

The muzzleloader 100 may be configured to fire a projectile, for example the projectile 402 as illustrated in FIG. 4. Suitable types of projectiles include, but are not limited to, lead shot, bird shot, a lead round ball, a lead Minié ball, a saboted bullet, a lead-jacketed or copper jacketed bullet having any of a spire point, round nose, hollow point, or flat nose, and a monolithic bullet having any of a spire point, round nose, hollow point, or flat nose.

Other embodiments of the muzzleloader 100 may have configurations other than the examples illustrated and described with reference to FIG. 1. For example, some of the components listed above are not included in some alternative embodiments.

Figure 2:
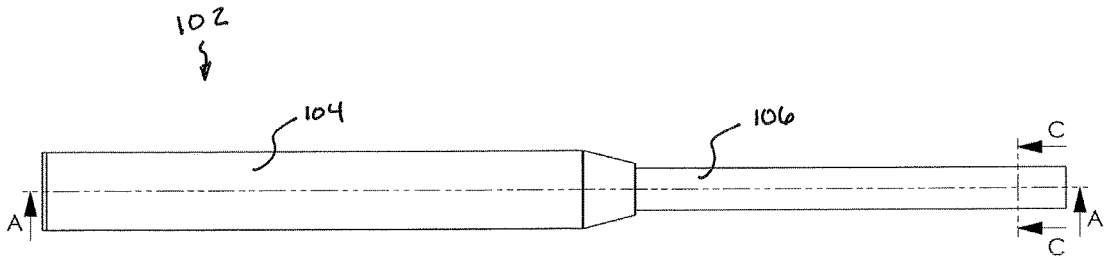
FIG. 2 illustrates a top view of a muzzleloader barrel suitable for use in a moderated muzzleloader of the present disclosure, such as the example moderated muzzleloader of FIG. 1.
Figure 3:
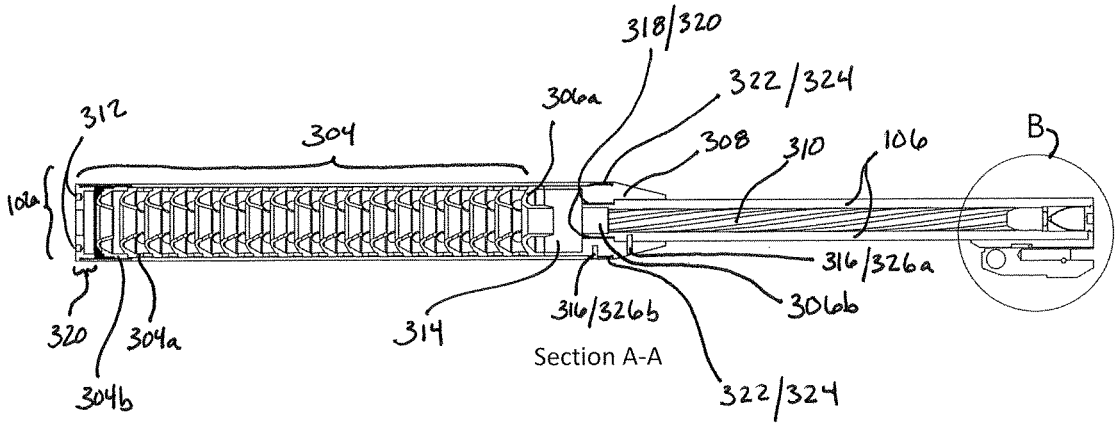
FIG. 3 illustrates a cross-sectional side view taken along section A-A of the muzzleloader barrel depicted in FIG. 2.

FIG. 2 illustrates a top view of the muzzleloader barrel 102 suitable for use in the muzzleloader 100 depicted in FIG. 1, according to some embodiments of the present disclosure. FIG. 3 is a cross-sectional view taken along section A-A of the muzzleloader barrel 102 depicted in FIG. 2.

In some embodiments, the sound moderator 104 of the muzzleloader barrel 102 includes a baffle portion 304 that includes a tension baffle 304*b* and a plurality of secondary baffles 304*a*. The tension baffle 304*b* and the plurality of secondary baffles 304*a* may be arranged in a configuration to reduce the noise from a report of a projectile fired from the muzzleloader 100. In some embodiments, the tension baffle 304*b* is threaded and configured to compress the plurality of secondary baffles 304*a*. The tension baffle 304*b* is permanently fixed to the sound moderator 104. For example, the tension baffle 304*b* may be welded to the inside of the sound moderator 104.

The muzzle end 102*a* of the muzzleloader barrel 102 may be enclosed by a threaded cap 320. The cap 320 may have one or more blind holes 312 enabling a pin spanner wrench to tighten the cap 320 onto the sound moderator 104. The cap may be secured to the muzzle end of the muzzleloader barrel by alternative means as well. In some examples, the muzzle end 102*a* may have a cylindrical opening that is large enough to allow a projectile and a drop tube 108 to pass there-through. In other examples, the muzzle end 102*a* may be tapered towards the rear end of the muzzleloader 100. The tapered shape of the muzzle end 102*a* may allow a drop tube 108 to be more easily inserted into the muzzleloader barrel 102.

In some embodiments, the sound moderator 104 may include at least one of a blast baffle 306*a*, an expansion chamber 314, and a drop tube receiver 306*b*. In one or more embodiments, the blast baffle 306*a* is configured to shear the gas from the expansion chamber 314. In some embodiments, the blast baffle 306*a* is configured to shear the gas toward at least one outside edge of the sound moderator 104. By shearing the gas, the movement of gas is slowed and the temperature of the gas is cooled, thereby reducing noise level of a fired projectile. In one or more embodiments, the drop tube 108 is inserted into a portion of the drop tube receiver 306*b*. The drop tube receiver 306*b* may be a recess machined into the barrel portion 106 configured to receive the drop tube 108. In one embodiment, the muzzleloader 100 may be loaded by inserting the drop tube 108 into the muzzle end 102*a*, inserting a projectile (e.g., a bullet) into the muzzle end 102*a*, and using a ramrod to push the projectile through the sound moderator 104 and into the barrel portion 106 until the projectile is seated on an outer surface of the seat pins 416.

In one or more embodiments, the sound moderator 104 and the barrel portion 106 are permanently fixed to one another. In one or more aspects, an end of the barrel portion 106 facing the muzzle end 102*a* may have a threaded portion 318, having either an external thread or internal thread, configured to be fastened to a threaded portion 320, having an internal thread or external thread to receive the corresponding thread of the threaded portion 318, of the receiver 306*b* of the bulkhead 308. In one or more aspects, the bulkhead 308 may have a threaded portion 322, having either an external thread or internal thread, configured to be fastened to a threaded portion 324, having an internal thread or external thread to receive the thread of the threaded portion 322, of the baffle portion 304 of the sound moderator 104. In one or more embodiments, the end of the barrel portion 106 is fastened to the receiver 306*b*, via the thread portions 318 and 320, and the bulkhead is fastened to the baffle portion 304 of the sound moderator 104, via the thread portions 322 and 324. Once the end of the barrel portion 106 and the receiver 306 are fastened together at least two bore holes 326 may be formed. A first bore hole 326*a* may extend from the outer diameter of the bulkhead 308 and into a portion the barrel wall of the end of the barrel portion 106. The portion of the barrel wall in which the first bore hole 326*a* is formed may be located in an end portion of the barrel portion 106 that does not include thread portion 318. A second bore hole 326*b* may extend from the outer diameter of baffle portion 304 of the sound moderator 104 and into a portion of the bulkhead 308. The bore holes 326*a* and 326*b* may each be a blind hole. A pin 316 may be inserted into each bore hole, such as the first bore hole 326*a* or second bore hole 326*b*, that is formed.

In one or more embodiments, the outer diameter of a bore hole 326, referring to the first bore hole 326*a* and/or second bore hole 326*b*, is configured into a shape for receiving the pin 316. For example, if pin 316 has a cylindrical shape, the bore hole 326 has a cylindrical shape with a diameter large enough to receive pin 316. In another example, if pin 316 is a screw, the outer walls of the bore hole 326 may be threaded to receive the screw shaped pin 316. The pin 316 may be a blind pin. The pin 316 may be long enough such that a space remains on an outer end of the bore hole 326 to fasten pin 316 into the bore hole 326. The pin 316 may be fastened by welding, press fitting, brazing, using an epoxy, or other fastening means. Excess material, such as weld metal, filler materials or epoxy, that extends beyond the outer diameter of the sound moderator 104 may be grinded or sanded down to the outer diameter of the sound moderator 104. In another example, the sound moderator 104 and the barrel portion 106 may be integrally formed, or may be welded together, either directly or through a bulkhead 308. In one or more embodiments, an air chamber located in the bulkhead extends radially around the barrel portion 106. In one or more embodiments, radial blind holes are formed into the bulkhead 308 that extends radially around the barrel portion 106. In some embodiments, the radial blind holes are used to lighten the weight of the bulkhead 308.

In some embodiments, the radial blind holes create additional volume for the expansion chamber. In some embodiments, each pin 316 may have a thickness of about 0.03 inches to about 0.15 inches, such as about 0.05 inches to about 0.125 inches. In some embodiments, the bore holes 326*a* and 326*b* are large enough to receive the pin 316. In some embodiments, the pin 316 for the first bore hole 326*a* is the same size as the pin 316 for the second bore hole 326*b*. In some embodiments, the pin 316 for the first bore hole 326*a* is larger than the pin 316 for the second bore hole 326*b*. In some embodiments, the pin 316 for the first bore hole 326*a* is smaller than the pin 316 for the second bore hole 326*b*.

Figure 5:
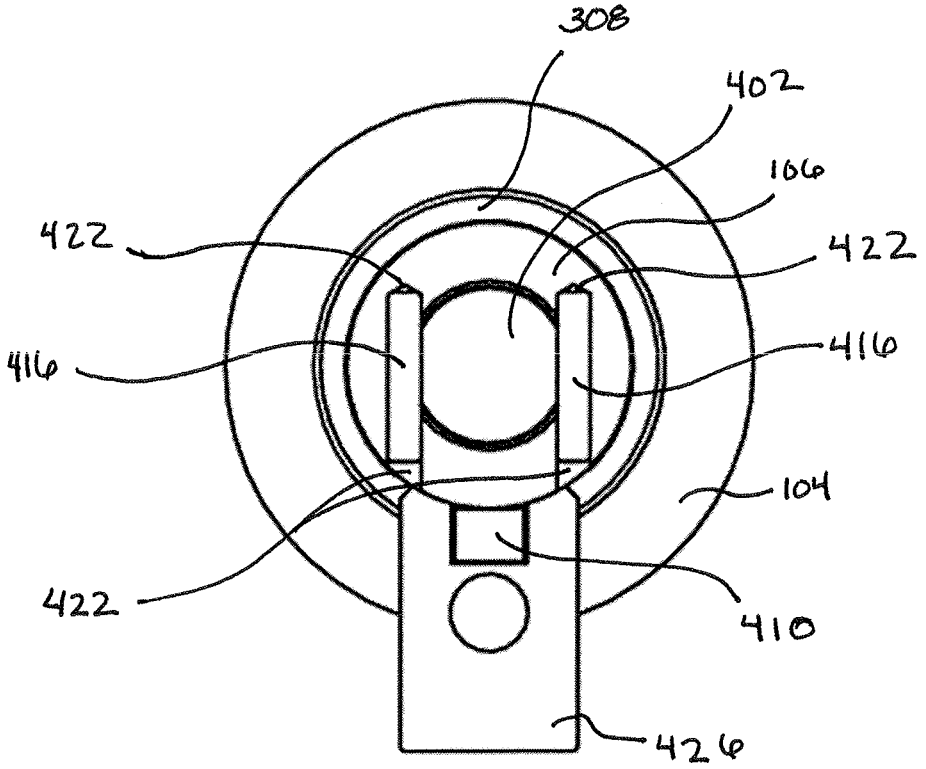
FIG. 5 illustrates a cross-sectional view taken along section C-C of the muzzleloader barrel depicted in FIG. 2.

FIG. 4 is an enlarged view of detail B highlighted in the cross-sectional view depicted in FIG. 3. FIG. 5 is a cross-sectional view taken along section C-C of the muzzleloader barrel 102 depicted in FIG. 2.

In some embodiments, the muzzleloader 100 is configured to operate without a conventional breech plug. In some embodiments, a breech 414 of the muzzleloader barrel 102 is configured to receive an ignition device 408 that is used as the ignition source to fire the projectile 402. The outer rim 424 of the ignition device 408 may be configured to fit within a recessed groove, such as recessed groove 702 shown in FIG. 7, on an outer end of the breech 414. The ignition device 408 may include at least one of a cartridge cap 404, powder 406, and primer 418. When the breech 414 is opened, such as when a user presses on the trigger guard spur 110*a* thereby breaking open the muzzleloader 100 and exposing the breech 414, the ignition device 408 may be inserted into the breech 414. In some embodiments, the ignition device 408 has a conical shaped end. In other embodiments, the ignition device 408 has a crimped end similar to that of ignition device 800. In some examples, the ignition device 408 may have a minimum length of about 0.5 inches and a maximum length of about 3 inches. In some examples, the ignition device 408 is long enough such that the outer rim 424 prevents the conical tip of the ignition device 408 from contacting the projectile 402. In some other examples, the ignition device 408 is long enough such that the outer rim 424 prevents the conical tip extending beyond the seat pins 416 on end closer to the projectile 402.

The powder 406 must be black powder or black powder substitute. In some examples, the black powder substitute may be in the form of a solid, such as a pellet, or may be in a loose powder form. The primer 418 may be positioned within the ignition device 408 to receive a strike from the hammer 118 of the muzzleloader 100. In a situation in which the primer 418 is struck by the hammer 118, the primer ignites the powder 406, thereby causing an explosion between the cartridge cap 404 and the powder 406. The energy generated by the explosion may travel through the breech 414 and propel the projectile 402 through the barrel portion 106 and sound moderator 104 and out of the muzzleloader 100.

In some embodiments, the breech 414 may be large enough to receive an ignition device 408. In some embodiments, the breech 414 has a larger diameter than the barrel bore 310. In some embodiments, one or more bore holes 422 may be formed into the barrel portion 106. The one or more bore holes 422 may be blind holes such that the bore hole 422 is drilled on a portion of the outer diameter of the barrel portion 106, and extending into the barrel portion 106 without breaking through the opposite side of the barrel portion 106. The one or more bore holes 422 are each formed perpendicularly into the barrel portion 106 for each seat pin 416, when viewed from a cross-sectional view taken along section A-A of the muzzleloader barrel 102. The bore holes 422 may be formed substantially parallel to one another. The bore holes 422 may be formed at the inner end of the breech 414. In some embodiments, the one or more bore holes 422 (and thus the one or more seat pins 416) may be formed in a variety of manners, including but not limited to radially, tangentially, or in a radial pattern, extending through or partially into the barrel bore 310. Non-limiting examples of suitable configurations of bore hole(s) and pin(s) include one tangential pin, two tangential pins, one pin fully through the barrel bore 310, two pins each fully through the bore, one pin protruding just into the barrel bore 310 substantially perpendicular to the bore, two pins each protruding just into the barrel bore 310 substantially perpendicular to the barrel bore 310, and combinations thereof. In one or more embodiments, the outer diameter of bore hole 422 is configured into a shape for receiving the seat pin 416. For example, if seat pin 416 has a cylindrical shape, the bore hole 422 has a cylindrical shape with a diameter large enough to receive seat pin 416. In another example, if seat pin 416 is a screw, the outer walls of the bore hole 422 may be threaded to receive the screw shaped seat pin 416.

In some embodiments, a seat pin 416 is inserted and fastened into each bore hole 422. For example, a seat pin 416 may be inserted into the bore hole 422. The seat pin 416 may be fastened by welding, press fitting, brazing, using an epoxy, or other fastening means. The seat pin 416 may be long enough such that a space remains on an outer end of the bore hole 422 to fasten, e.g., via welding, the seat pin 416 into the bore hole 422. Excess material, such as weld metal or filler materials, that extends beyond the outer diameter of the barrel portion 106 may be grinded or sanded down to the outer diameter of the barrel portion 106. In some embodiments, a portion of each seat pin 416 extends into the space defined by the barrel bore 310, when viewed from a cross-sectional view taken along section C-C of the muzzleloader barrel 100. In some embodiments, the seat pin(s) 416 is protrudes into the barrel bore 310 far enough to allow a projectile to be loaded from the muzzle end 102*a* and be seated on the seat pin(s) 416. Further, in some embodiments, the seat pin(s) 416 protrudes into the barrel bore 310 far enough to prevent a projectile from being loaded into the barrel bore 310, via inserting the projectile into the breech 414.

In some embodiments, each seat pin 316 may have a thickness of about $3/64^{th}$ of an inch to about $1/8^{th}$ of an inch. In some embodiments, the seat pin(s) 416 is thick enough to allow a projectile be fired via the firing mechanism without damaging the structural integrity of the seat pin(s) 416. Moreover, the seat pin(s) 416 may be thick enough to seat the projectile 402 as close to the end 420 of the ignition device 408 as possible. For example, the seat pin(s) 416 may each have a thickness of 0.03 inches or about 0.03 inches. In some embodiments, the seat pin(s) 416 protrude across about 60% to about 90% of the diameter of the barrel bore 310. In one embodiment, the seat pin(s) 416 are formed from tungsten carbide or an alloy thereof. In other embodiments, the seat pin(s) 416 may be formed from ceramic or a high nickel alloy. In some embodiments, a portion of at least one seat pin 416 may extend far enough into the space defined by the barrel bore 310 to prevent a bullet from being loaded into the barrel bore 310 from the breach end of the muzzleloader 102.

Figure 6:
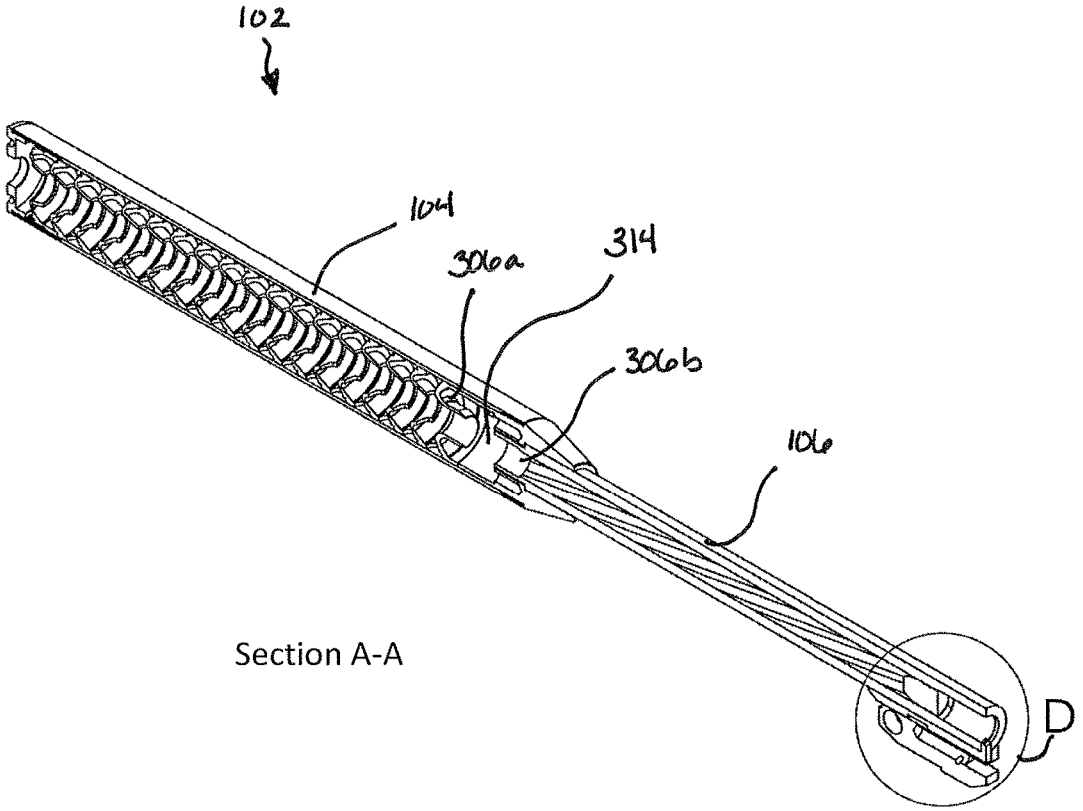
FIG. 6 illustrates a cross-sectional isometric view taken along section A-A of the muzzleloader barrel depicted in FIG. 2.
Figure 7:
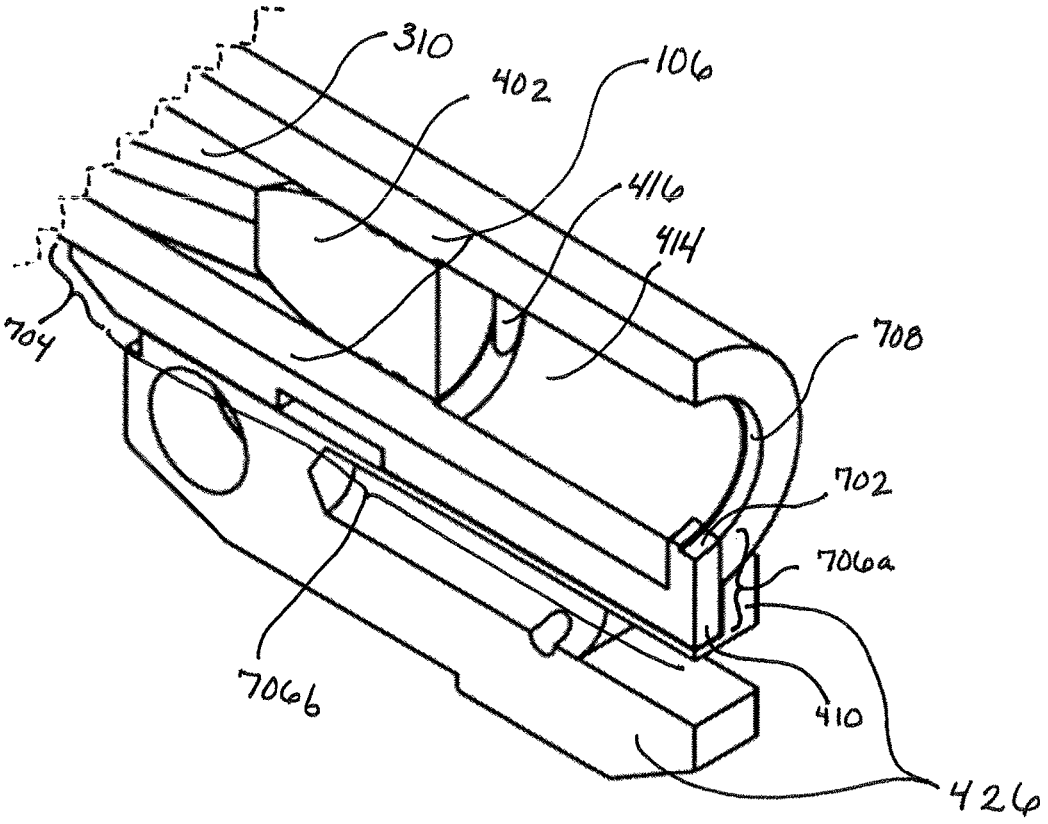
FIG. 7 illustrates an enlarged view of detail E highlighted in the cross-sectional isometric view of the muzzleloader barrel depicted in FIG. 2.

FIG. 6 is a cross-sectional isometric view taken along section A-A of the muzzleloader barrel 102 depicted in FIG. 2. FIG. 7 illustrates an enlarged view of detail E, without the ignition device 408, highlighted in the cross-sectional isometric view of the muzzleloader barrel depicted in FIG. 2.

In some embodiments, an extractor 410 is located on the outer diameter of the barrel portion 106. In some embodiments, a receiver lug 426 is configured to house the extractor 410. In some embodiments, the extractor 410 is encapsulated in the receiver lug 426. The receiver lug 426 is located over the at least one seat pin 416 and the extractor 410 such that the at least one seat pin 416 cannot be removed. The barrel portion 106 may be attached to the receiver 122 via the receiver lug 426.

The extractor 410 may include a horizontal portion 706*b* and a longitudinal portion 706*a*, forming a right angle. The right angle portion of the extractor 410 may be located on an outer end portion of the barrel portion 106. The upper end of the longitudinal portion 706*a* may have a recessed groove 702. The recessed groove 702 may extend transversely across the extractor 410. In some embodiments, the breech 414 has a recessed groove 708 on an outer end of the breech 414. In an embodiment, the recessed groove 708 extends around the outer diameter of the breech 414. The recessed groove 702 and recessed groove 708 may be aligned to form a continuous groove around the outer diameter of the breech 414. In some embodiments, when an ignition device 408 is inserted into the breech 414, an outer rim of the ignition device 408 may interlock with recessed groove 702 and recessed groove 708. The depth for each of the recessed groove 702 and the recessed groove 708 may correspond to a thickness of the outer rim of the ignition device 408 such that when the ignition device 408 is inserted into the breech 414, the outer surface of the longitudinal portion 706*a* and the outer surface of the ignition device 408 are flush with one another or lie on substantially the same vertical plane.

The extractor 410 may be configured to slide in a longitudinal direction of the muzzle loader barrel 102. The extractor 410 may move forward and backward under the receiver lug 426 to extract the ignition device 408. In some embodiments, the extractor 410 has a ramp end 704 on the horizontal portion 706*b* of the extractor 410. In some embodiments, an end portion of the receiver 122 has a ramp shape or flat shape configured to press against the ramp end 704 when the muzzleloader 100 is moved to a break open position. As a user moves the muzzleloader 100 into a break open position, the end portion of the receiver 122 engages with a surface of the ramp end 704 of the horizontal portion 706*b*, thereby driving the extractor 410 reward towards the rear end of the breech 414. That is, the end portion of the receiver 122 engages the ramp end 704, and slides the extractor 410 from a load position to an eject position. As the extractor 410 moves to the eject position, the recessed groove 702 pushes the inside of the outer rim of the ignition device 408 in an outward manner, thereby sliding the ignition device 408 out of the breech 414. In some embodiments, the extractor 410 may be configured to partially eject the ignition device 408 from the breech 414. In other embodiments, the extractor 410 may be configured to fully eject the ignition device 408 from the breech 414. In some embodiments, the ramp end 704 of the horizontal portion 706*b* may have a tapered shape towards the front of the muzzleloader 100.

Figure 8:
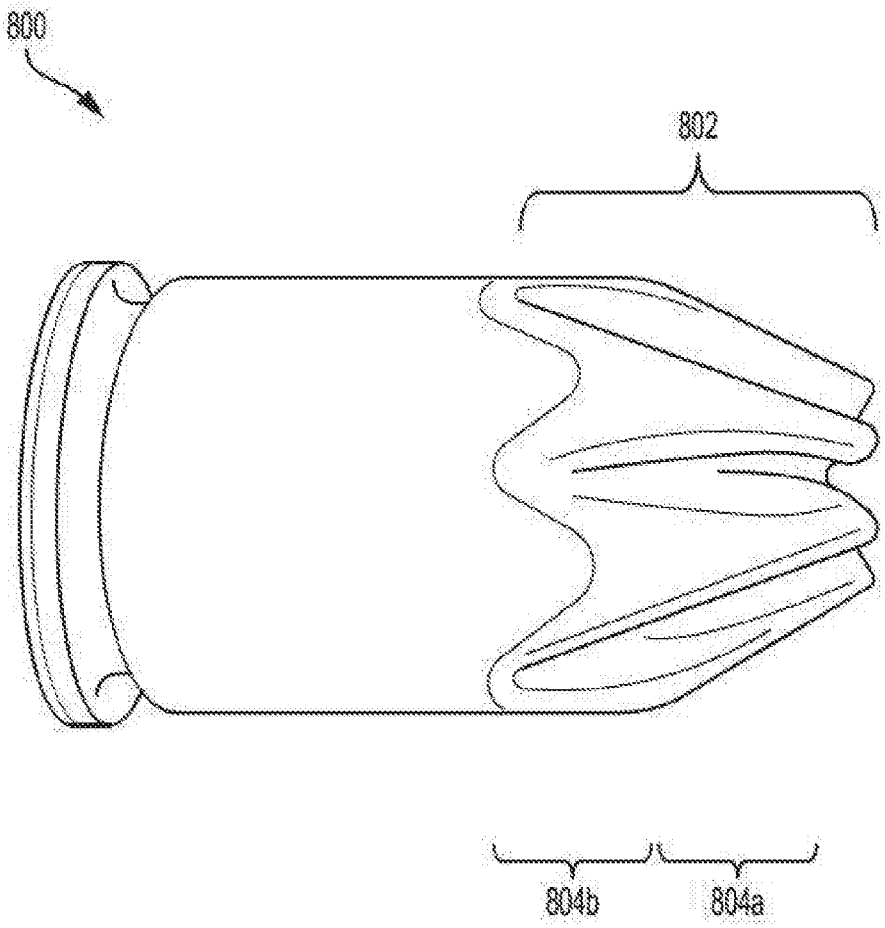
FIG. 8 illustrates an ignition device suitable for use in a moderated muzzleloader of the present disclosure, such as the example moderated muzzleloader of FIGS. 1-7.

FIG. 8 illustrates an ignition device 800 suitable for use in the muzzleloader barrel 102 depicted in FIGS. 1-7. In some embodiments, ignition device 800 includes the powder 406, primer 418, and the outer rim 424 discussed above with respect to ignition device 408, as such a discussion of these features will not be repeated. In some embodiments, ignition device 800 has a crimped end 802. The crimped end 802 may form a conical shape. In some embodiments, the crimped end 802 is configured to open when the powder 406 is ignited via the primer 418. In some embodiments, a front portion 804*a* of the ignition device 800 extends beyond an outer edge of at least one seat pin 416, such that the projectile 402 can be seated closer to the ignition device 800 than ignition device 408. In some embodiments, a rear portion 804*b* of the ignition device 800 is configured to contact an outer edge of at least one seat pin 416, preventing the ignition device 800 from entering the barrel bore 310.

As used herein, the term "about" in reference to a numerical value means plus or minus 15% of the numerical value of the number with which it is being used.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A sound moderated muzzleloader, comprising:

a barrel portion having a forward end, a rearward end, and a central bore, the central bore having a central axis;

a sound moderator permanently attached to the forward end of the barrel portion; and at least one seat pin that protrudes into a portion of the central bore of the barrel portion, the at least one seat pin being secured to an interior of the barrel portion;

wherein the sound moderator comprises a plurality of baffles, and wherein the rearward end of the barrel comprises a breech configured to receive an ignition device.

2. The sound moderator of claim 1, further comprising at least one pin configured to permanently attach the sound moderator to the forward end of the barrel.

3. The sound moderated muzzleloader of claim 1, wherein at least one seat pin is formed from a material comprising tungsten carbide.

4. The sound moderated muzzleloader of claim 1, wherein the total weight of the muzzleloader is about 4 to about 6 pounds.

5. The sound moderated muzzleloader of claim 1, wherein the ignition device has a length of about 0.5 to about 3 inches.

6. The sound moderated muzzleloader of claim 1, wherein at least one seat pin is arranged tangentially to the central bore.

7. The sound moderated muzzleloader of claim 1, wherein the interior portion of the barrel comprises two seat pins.

8. The sound moderated muzzleloader of claim 7, wherein the two seat pins are substantially parallel to each other.

9. The sound moderated muzzleloader of claim 1, wherein the plurality of baffles comprises a tension baffle and secondary baffles, wherein the tension baffle is configured to compress the secondary baffles.

10. The sound moderated muzzleloader of claim 1, wherein at least one seat pin protrudes across about 60% to about 90% of the diameter of the central bore.

11. The sound moderated muzzleloader of claim 1, wherein the barrel portion and the sound moderator have a combined length of more than 16 inches.

12. The sound moderated muzzleloader of claim 1, wherein the breech is configured such that the ignition device cannot contain a projectile.

13. The sound moderated muzzleloader of claim 1, wherein the ignition device comprises a propellant powder and a primer.

14. The sound moderated muzzleloader of claim 13, wherein the propellant powder is black powder or black powder substitute.

15. The sound moderated muzzleloader of claim 1, wherein the muzzleloader does not include a breech plug.

16. The sound moderated muzzleloader of claim 1, wherein the at least one pin is secured to the interior of the barrel portion by being press-fit into the interior of the barrel portion.

* * * * *